US006021521A

United States Patent [19]

Baratta

[11] Patent Number: 6,021,521

[45] Date of Patent: Feb. 8, 2000

[54] BIB AND HIGHCHAIR TRAY

[76] Inventor: Anthony V. Baratta, 768 Admiralty Way, Webster, N.Y. 14580

[21] Appl. No.: 09/151,975

[22] Filed: Sep. 11, 1998

[51] Int. Cl.[7] ..... A41B 13/10

[52] U.S. Cl. ..... 2/49.1; 2/49.2

[58] Field of Search ..... 2/46, 48, 49.1, 2/49.2, 49.3, 49.4, 49.5, 50, 51, 52, 74, 106, 105, 113, 114, 115

[56] References Cited

U.S. PATENT DOCUMENTS

| | | | |
|---|---|---|---|
| 590,991 | 10/1897 | Lenhart . | |
| 797,434 | 8/1905 | Homeyer . | |
| 889,073 | 5/1908 | Walbridge . | |
| 1,108,557 | 8/1914 | Dudley . | |
| 2,362,465 | 11/1944 | Carner . | |
| 2,377,747 | 6/1945 | Berkowitz . | |
| 2,532,932 | 12/1950 | Neiswander . | |
| 2,643,384 | 6/1953 | Thompson | 2/49.3 |
| 2,738,511 | 3/1956 | Brady . | |
| 2,905,943 | 9/1959 | Carlisle et al. | 2/49.3 |
| 3,851,336 | 12/1974 | Hjerl . | |
| 4,797,952 | 1/1989 | Petrini . | |
| 4,811,428 | 3/1989 | Waldman et al. | 2/49.1 |
| 5,062,558 | 11/1991 | Stang . | |
| 5,457,820 | 10/1995 | Yielding . | |
| 5,490,289 | 2/1996 | Lehrer . | |
| 5,498,219 | 3/1996 | Soufi . | |
| 5,530,968 | 7/1996 | Crockett | 2/46 |

OTHER PUBLICATIONS

Gershman, Maurice, "Self–Adhering Nylon Tape." The J.A.M.A, vol.168, No. 7, p. 930, Oct. 1958.

*Primary Examiner*—Gloria M. Hale
*Attorney, Agent, or Firm*—Nixon Peabody LLP

[57] ABSTRACT

The present invention provides a bib for directing food or liquid onto a tray. The invention further provides a tray having a site for attaching a lower end of a bib to the tray so that food or liquid spilled onto the bib will be directed onto the tray. Yet another embodiment of the invention is a tray and bib combination. The combination has a tray with a site for attaching a lower end of a bib to the tray, and a bib which attaches to the tray so that food or liquid spilled onto the bib will be directed onto the tray.

18 Claims, 6 Drawing Sheets

BIB AND HIGHCHAIR TRAY

FIELD OF THE INVENTION

The present invention relates to a bib and a highchair tray, where the bib attaches to the highchair tray, in order to protect the clothing of the user from falling food or a liquid. Dropped food material bounces or rolls of the bib, directly onto the highchair tray.

BACKGROUND OF THE INVENTION

Bibs which are releasably attachable to the user's body, and which protect the user's clothing from dropped food or liquid, are known in the art. Bib and tray combinations are also known in the art. For example, U.S. Pat. No. 2,362,465 discloses a bib that also restrains a child in a highchair. The bib covers the front of the child and extends over the entire tray. After the child eats, the bib and tray are removed and the bib is then cleaned. Other prior art systems, such as those disclosed in U.S. Pat. Nos. 1,108,557 and 5,062,558, also relate to bibs with built-in trays.

Although a bib protects the front of the wearer from spilled food and liquid, the food or liquid can run down the front of the bib onto the lap of the wearer or onto the chair or floor. The system disclosed in U.S. Pat. No. 5,457,820 pertains to a bib which attaches to a car seat or stroller and serves as a holder or catch for food and toys. Other prior art, as disclosed in U.S. Pat. Nos. 590,991 and 2,536,932, relates to bibs which hook onto or near a highchair tray to prevent food from falling between the child and tray. However, these bibs, as in U.S. Pat. No. 5,457,820, form a pocket between the child and tray in order to collect falling food and liquid. The pocket is not effective for retaining spilled liquid, which is likely to fall out of the bib and onto the user. Finally, it is cumbersome to clean up food or liquid, which has accumulated in the bib pocket.

Thus there is a need for a bib which attaches to a highchair tray, protects the user from falling food or liquid, and allows the dropped material to be directed onto the tray so that the spill is contained. There is a need for such a system to allow easy clean up of food or liquid from the tray and bib.

SUMMARY OF THE INVENTION

The present invention provides a bib for directing food or liquid onto a tray. The bib has a body having a front and a back, a top edge and a bottom edge. The top edge forms a neck portion that wraps around the wearer's neck. The body also has a chest portion and a bottom portion, where the bottom portion has a fastener, which attaches the bottom portion of the bib to a tray. The bib attaches to the tray in such a manner that food or liquid spilled onto the chest portion is directed onto the tray.

The invention further provides a tray having a site for attaching a lower end of a bib to the tray so that food or liquid spilled onto the bib will be directed onto the tray.

Yet another embodiment of the invention is a tray and bib combination. The combination has a tray with a site for attaching a lower end of a bib to the tray, and a bib, which attaches to the tray so that food or liquid spilled onto the bib will be directed onto the tray. The bib has a front and a back, a top edge and a bottom edge, where the top further comprises a neck portion which wraps around the wearer's neck. The body comprises a chest portion and a bottom portion, where the bottom portion has a fastener which attaches the bottom portion of the bib to the site for attaching to the tray.

DETAILED DESCRIPTION OF THE INVENTION

The present invention provides a bib which attaches to a tray, preventing food from falling in between the child and the tray. Furthermore, the bib directs spilled food or liquids onto the tray, where spills will be contained and easily cleaned. The bib protects the sitter's clothing and minimizes spillage of food or liquid onto the seat or floor.

Figure 3:
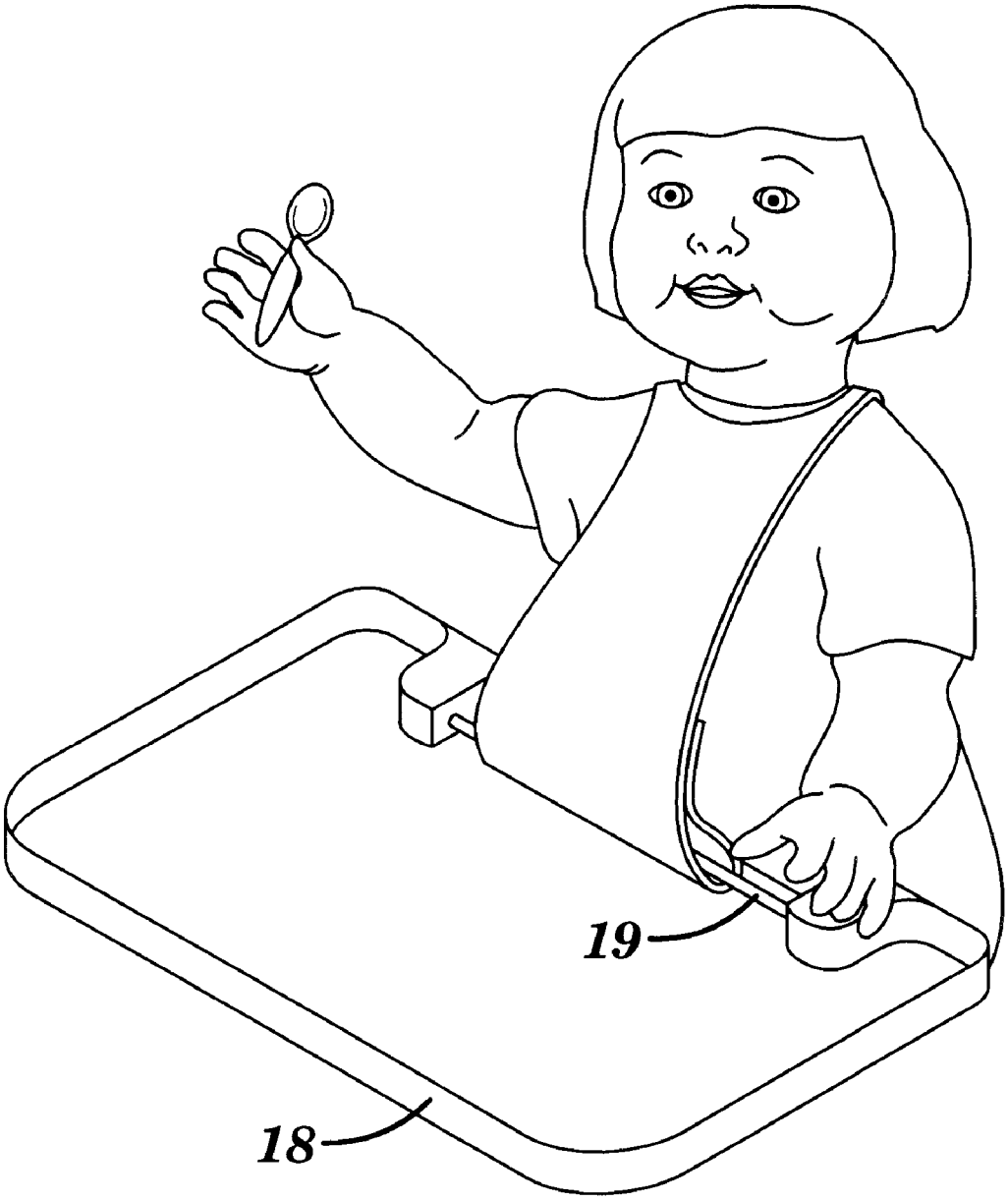
FIG. 3 is a view of an occupied highchair with the bib fastened as in normal use.
Figure 6:
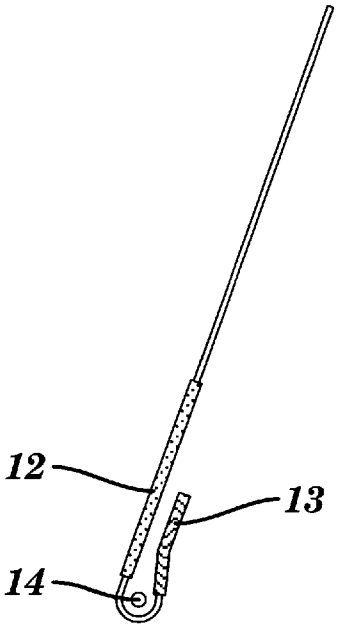
FIG. 6 is the side plan view of the bib fastened around the bar, on a taller child.
Figure 5:
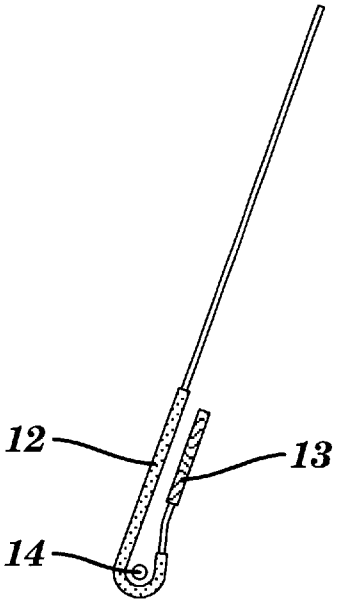
FIG. 5 is the side plan view of the bib fastened around the bar, on a shorter child.

The bib consists of a body 1 and a neck portion 2, a bottom edge 5 and two side edges 6. The main body compromises a chest portion 3 and a bottom portion 4, which may wrap around a rigid bar on the tray, as shown in FIG. 3. The body also has a chest portion and a bottom portion, where the bottom portion has a fastener which attaches the bottom portion of the bib to a tray. The bib extends from the wearer to the tray without dropping below the top surface of the tray. In this manner, excess food or liquid which is spilled onto the bib will move down the bib and onto the tray.

Figure 1:
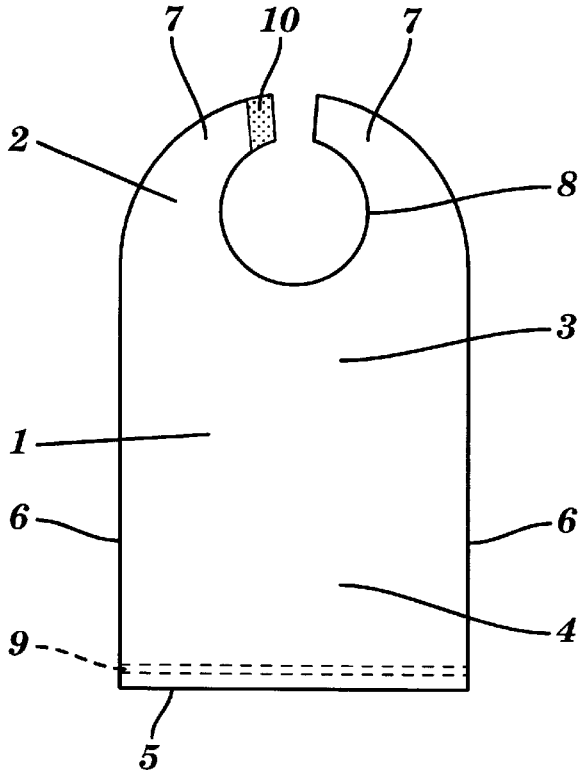
FIG. 1 is the front view of the bib.
Figure 2:
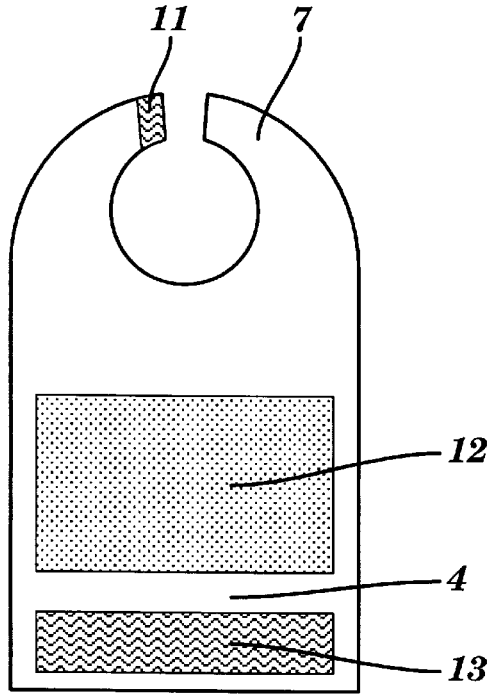
FIG. 2 is the reverse view of the bib.

The neck portion 2 consists of two segments 7 that encircle the sitter's neck. It is to be understood that the present invention is not limited to any particular shape, style or make of bib or bib attachment or securement. For example, the bib may include snaps, button, ties, strings, snap buttons, attached strings, hooks, magnets, releasable fasteners such as VELCRO brand straps, or the like, for securing the bib in position, and the bib may have a rectangular, circular, oval or other shape to the bib body. In a preferred embodiment, the neck segments 7 fasten together with opposing strips of hook and loop tape 10 and 11, as shown in FIGS. 1 and 2.

The bib may be of any color and may have designs or patterns on the surface. Darker colors or patterns may be preferred which would obscure any stains to the bib.

The bib, like other bibs, is constructed out of any material that is wearable and flexible. The bib can be made with a variety of materials including water repellent materials such as plastic. A preferred embodiment of the invention is a bib having a smooth water repellent surface, so that spilled food or drink will readily be directed onto the tray for easy cleaning. The bib may have a cloth covering.

The bib may be made of a washable and reusable material. The bib may be constructed from cloth fabric, polyester/ nylon, polyvinyl chloride, or other impermeable flexible material, which will not permit fluid to pass through to the wearer's clothing. Preferred materials for a washable and reusable bib include materials which are durable and capable of being machine washed. Also preferred are materials which can be easily wiped clean.

Alternatively, the bib may be disposable. Preferred materials for disposable bibs include paper and plastics. Preferred fasteners for disposable bibs are adhesive tapes with a removable backing. Disposable bibs for use in restaurants may be decorated with a logo or design associated with the facility.

The bottom portion of the bib has a fastener for attaching a lower end of a bib to the tray so that food or liquid spilled onto the bib will be directed onto the tray. The fastener may fasten directly to the tray. For example, the fastener may be snaps, hooks, magnets, adhesive tape, or hook and loop fasteners, such as VELCRO brand straps, which would connect the bib directly to the tray.

In an alternative embodiment, the fastener would connect the bottom edge of the bib to the back of the bib. This arrangement allows for the bottom edge of the bib to be secured around a bar on a tray. The lower portion of the bib has hook and loop tape, such as VELCRO, on its reverse side. The lower portion can therefore wrap over and around a horizontal bar and fasten upon itself, hence providing the means for connecting the bib to the highchair tray. This lower portion is easily attachable, such that the time needed to connect the bib to the try is no longer than that required to secure the top portion behind the user's neck.

Figure 4:
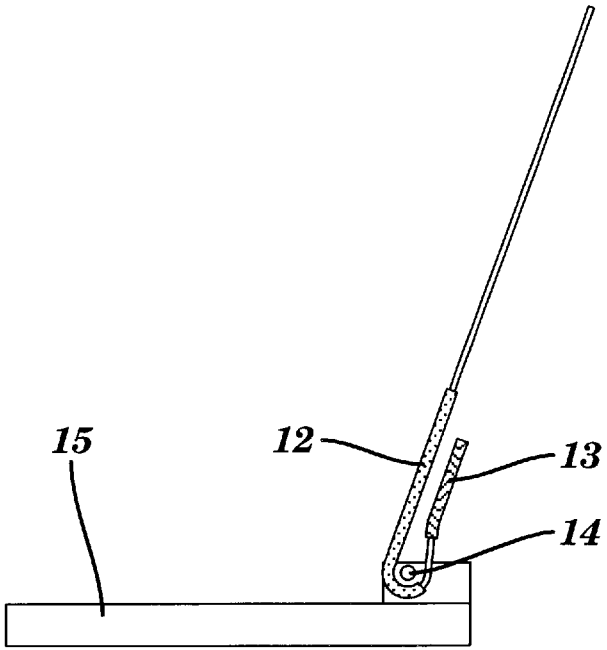
FIG. 4 is the side plan view of the bib attached to a highchair tray.

A preferred embodiment of the invention is shown in FIGS. 2–6. The reverse side of the bib (FIG. 2) has along its bottom portion 4, two horizontal rectangular strips of opposing hook and loop tape 12 and 13, such as VELCRO. The portion of the bib with the bottom strip 13 wraps over and around a rigid horizontal bar 14 on the highchair tray 15 and fastens against the top strip 12 at a desired point of contact (FIGS. 3 and 4). The top strip 12 is tall enough in its vertical dimension so as to offer multiple points of contact, such that the bib may be used on children of different sizes. For shorter children, a longer segment of the bib's bottom portion 4 may be wrapped around the bar 14 before being fastened, as in FIG. 5. For taller children, a shorter segment can be wrapped around the bar before being fastened, as in FIG. 6.

Figure 7:
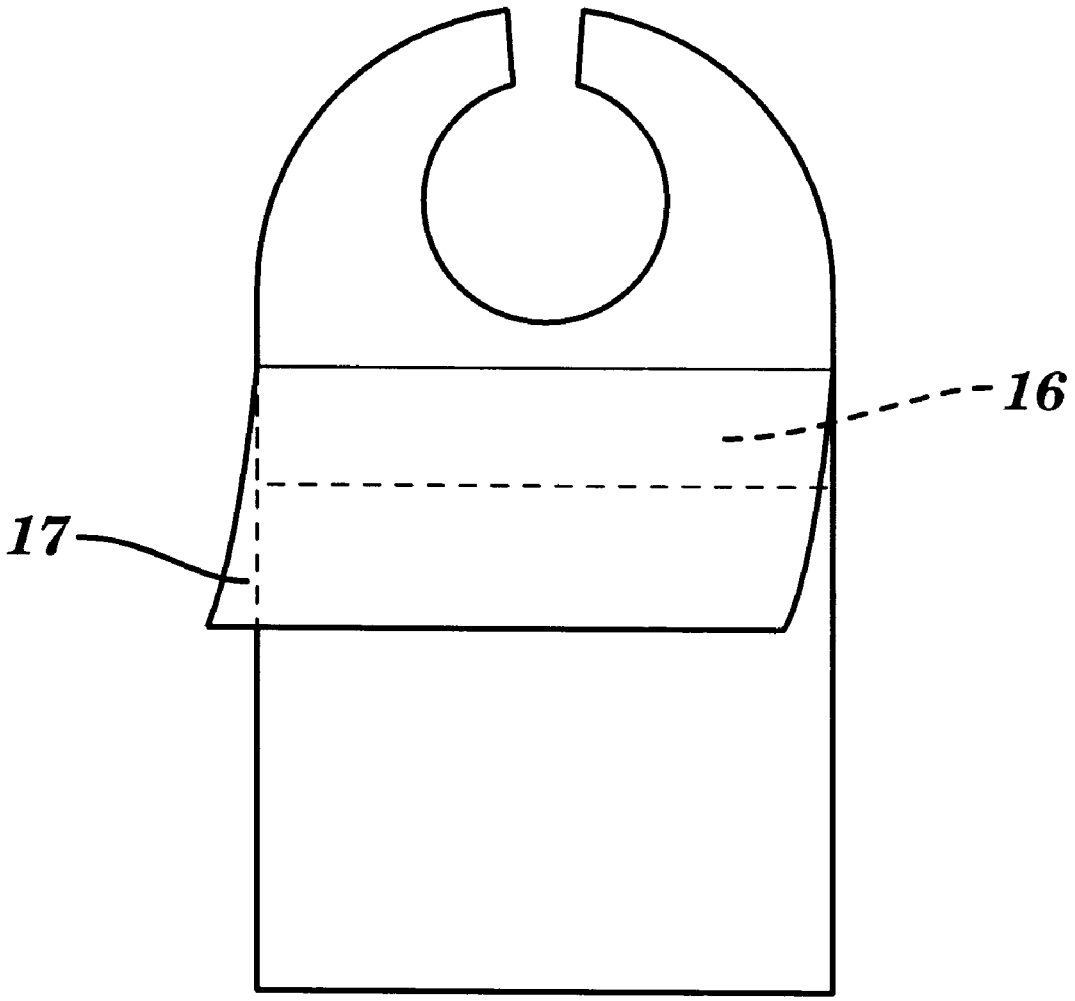
FIG. 7 is the front plan view of the bib, with a flap covering a LYCRA segment.
Figure 9:
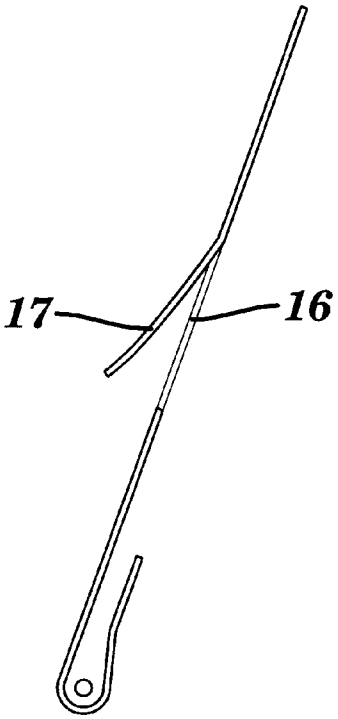
FIG. 9 is the side plan view of the bib, with LYCRA in a stretched position.
Figure 8:
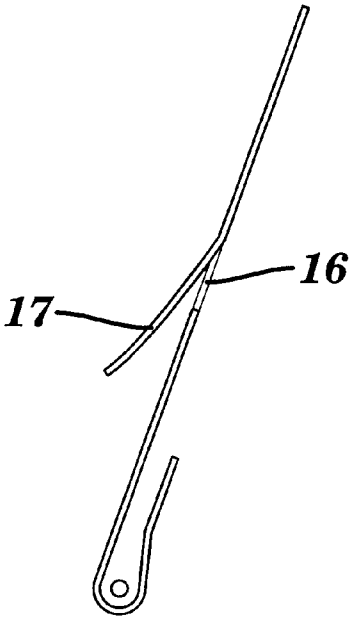
FIG. 8 is the side plan view of the bib, with LYCRA in neutral position.

One modification of the bib's design, shown in FIGS. 7–9, allows for an interposed horizontal segment of elastic material 16, such as LYCRA, in the bib's chest portion 3 or main body 1. This offers flexibility in the length of the bib, allowing children to lift their heads upward and backward without feeling restricted. The LYCRA segment 16 may stretch from the neutral portion in FIG. 8 to the elongated position in FIG. 9. A flap 17 of waterproof bib material may cover the LYCRA segment 16, since the elastic material may be semi-permeable to dropped liquid in the stretched position. The flap 17 may be constructed of the same material as that of the bib proper.

Figure 10:
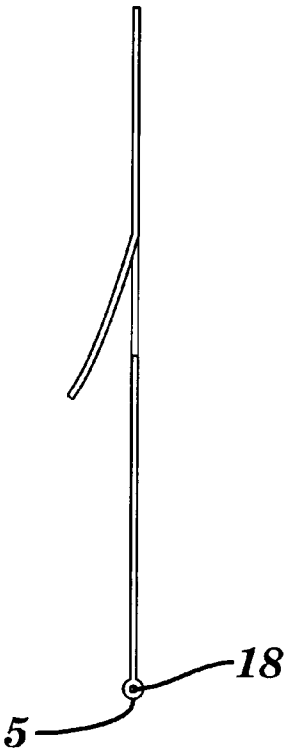
FIG. 10 is the side plan view of the bib, with stiffening rod in bottom edge.

A stiffening material may be used in the bib to keep the bib spread open. One embodiment, shown in FIGS. 1 and 10, has a rigid horizontal rod 9 constructed of metal or other sturdy material which may be sewn within the bib along its bottom edge 5. The purpose is to stiffen that portion of the bib, making it easier to be wrapped around he bar of the highchair tray. The stiffening material may be made of any material which may be incorporated into the bib and which would help the bib to maintain its shape, including but not limited to metal, plastics, cloth, or cardboard.

Stiffening materials may also be used above or below an elastic section of the bib to prevent gathering by the elastic material and to insure a smooth surface and proper fitting. In a preferred embodiment, the stiffening material is incorporated into the bib just above an elastic section of the bib.

The invention further provides a tray having a site for attaching a lower end of a bib to the tray so that food or liquid spilled onto the bib will be directed onto the tray. The tray may be a highchair tray or a tray on a car seat, a stroller, or walker. In a preferred embodiment, the tray is a highchair tray.

In a preferred embodiment, the tray has a lip 18 extending upwards from the outer edge of the tray. The edge would contain any spilled food or liquid on the tray. The lip should be sufficiently high to contain a spill while allowing for the easy removal and clean up of the tray.

In one embodiment of the invention, the site for attaching a lower end of a bib will be a site where a fastener on the bib can connect directly to the tray. For example, a snap, hook, magnet or hook and loop tape may be located on the tray to connect to a complimentary fastener on the bottom edge of the bib. Preferably, the fasteners would connect inside of a lip on the tray.

In another embodiment of the invention, the site for attaching a lower end of a bib is one or more bars 19 or 20 or loops around which the lower end of the bib, or portions thereof, can be wrapped. The bars or loops are preferably located inside a lip of the tray to direct food of liquid inside of the lip. In a preferred embodiment at bar is permanently attached to the tray 19. In other words, the tray may be made with a bar or loops built into the tray as shown in FIG. 3. The rigid bar 14 is attached to the top surface of the tray 15 at sufficient height to allow an adult to easily wrap the bib's bottom portion 4 around the bar. It is low enough so as not to obstruct the child's arms or hands from picking up food off the tray.

Figure 11:
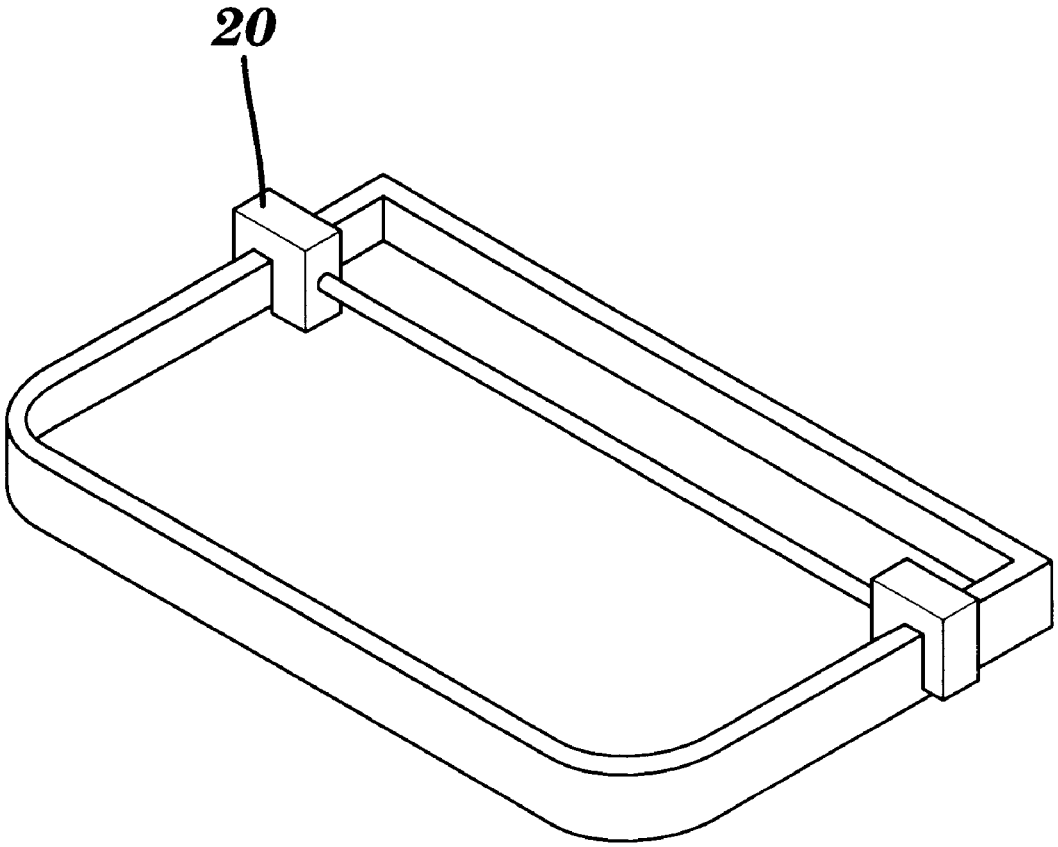
FIG. 11 is a view of the tray with an attached removable bar.

Alternatively, a bar may be attached removably to the tray 20. As shown in FIG. 11, the bar attaches at its ends to the sides or lip of the tray. For example, the bar may attach to the sides of the trays and clamps, screws, hooks, or an adhesive. Alternatively, the bar may contain an internal spring which would allow the bar to be suspended between the lip on each side of the tray. In a preferred embodiment, the bar is adjustable in length to fit various sizes of trays.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A bib for directing food or liquid onto a tray, comprising:

a body having a front and a back, a top edge and a bottom edge, the top further comprises a neck portion which wraps around the wearer's neck, and the body comprises a chest portion and a bottom portion where the bottom portion has a fastener which attaches the bottom portion of the bib to a tray such that the bib extends from the wearer's neck to the surface of the tray inside a lip of the tray, wherein said bib does not drop below the surface of the tray.

2. The bib according to claim 1, wherein the neck portion consists of two segments extending from the top edge of the body which meet and attach behind the wearer's neck with fasteners.

3. The bib according to claim 1, wherein the fasteners are selected from the group consisting of a snaps, buttons, ties, strings, snap buttons, attached strings, hooks, magnets, and hook and loop fasteners.

4. The bib according to claim 1, wherein at least a portion of the body of the bib comprises an elastic material.

5. The bib according to claim 4, wherein a rigid material is incorporated into the bib just above or below the elastic material.

6. The bib according to claim 1, wherein the bib is disposable.

7. The bib according to claim 1, wherein the bib comprises a plastic material.

8. The bib according to claim 1, wherein the bib comprises a paper material.

9. The bib according to claim 1, wherein the bib is reusable.

10. The bib according to claim 1, wherein a rigid or stiff material is incorporated within the bib along the bottom edge of the bib.

11. A tray and bib combination comprising:

a tray with a lip extending upwards from an outer edge; and a site for attaching a lower end of a bib to the tray so that the bib attaches to the surface of the tray inside the lip of the tray; said site comprises a bar around which the lower end of the bib can be wrapped.

12. The tray according to claim 11, wherein the site for attaching a lower end of a bib on said tray comprises a bar around which the lower end of the bib can be wrapped.

13. The tray according to claim 12, wherein the bar is permanently attached to the tray.

14. The tray according to claim 12, wherein the bar is removably attached to the tray.

15. A tray and bib combination comprising:

a tray comprising a site for attaching a lower end of a bib to the tray, and a bib having a front and a back, a top edge and a bottom edge, where the top further comprises a neck portion which wraps around the wearer's neck and the body comprises a chest portion and a bottom portion where the bottom portion has a fastener which attaches the bottom portion of the bib to the site for attaching to the tray so that the bib extends from the wearer's neck to the surface of the tray inside the lip of the tray, wherein said bib does not drop below the surface of the tray.

16. The tray and bib combination according to claim 15, wherein the tray has a lip extending upwards from an outer edge.

17. The tray and bib combination according to claim 15, wherein the site for attaching a lower end of a bib on said tray comprises a bar around which the lower end of the bib can be wrapped.

18. The tray and bib combination according to claim 17, wherein the bar is permanently attached to the tray.

* * * * *